United States Patent [19]

McCoy, Sr. et al.

[11] Patent Number: 4,846,468

[45] Date of Patent: Jul. 11, 1989

[54] TEAM ARM WRESTLING MACHINE

[75] Inventors: Goerge W. McCoy, Sr.; George W. McCoy, Jr., both of Olathe, Kans.

[73] Assignee: McCoy Manufacturing Company, Olathe, Kans.

[21] Appl. No.: 95,761

[22] Filed: Sep. 14, 1987

[51] Int. Cl.[4] ..... A63B 21/28

[52] U.S. Cl. ..... 273/1 GI; 272/67; 272/901; 272/902

[58] Field of Search ..... 273/1 GI, 1 GC; 272/901, 902, 67

[56] References Cited

U.S. PATENT DOCUMENTS 681,664 8/1901 Addleman ..... 272/902 X 3,301,555 1/1967 Sicherman ..... 272/902 X 4,463,949 8/1984 McCoy, Sr. et al. ..... 273/1 GI

*Primary Examiner*—Paul E. Shapiro

*Attorney, Agent, or Firm*—Hovey, Williams, Timmons & Collins

[57] ABSTRACT

An arm wrestling machine particularly adapted for team play includes a series of lever and handle assemblies linked together in pivotal alignment. The arm wrestling machine includes two or more shafts pivotally mounted on a horizontal, supporting surface, each shaft carrying mated lever and handle assemblies. The contestants on each side of the table compete as a team by grasping the lever and handle assemblies and attempting to force the lever and handle assembly held by the opponents downwardly.

18 Claims, 2 Drawing Sheets

FIG. 4C
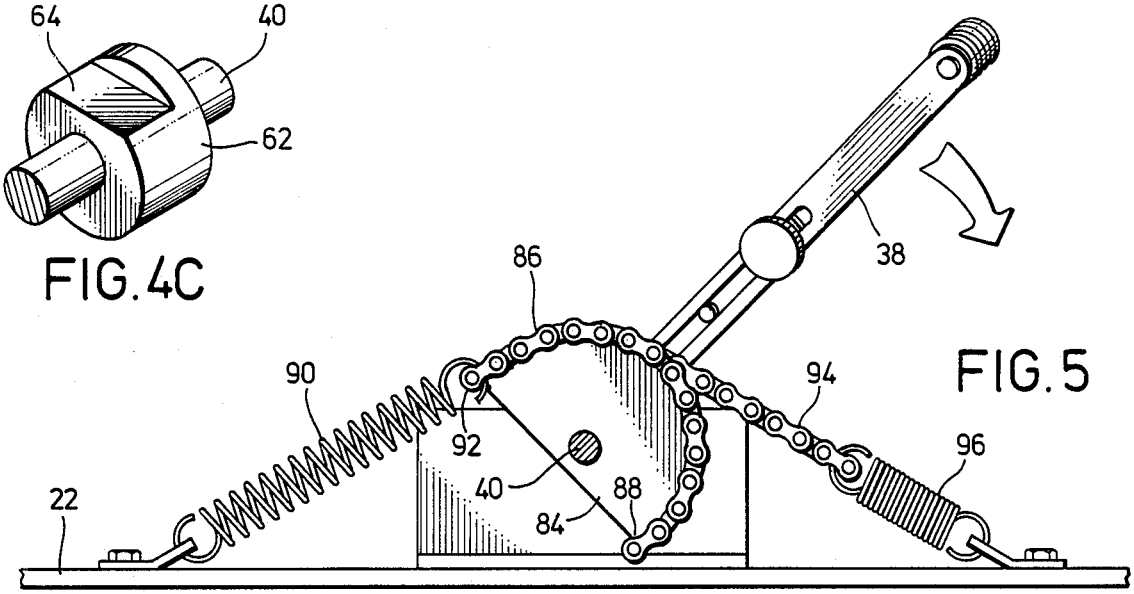
FIG. 5
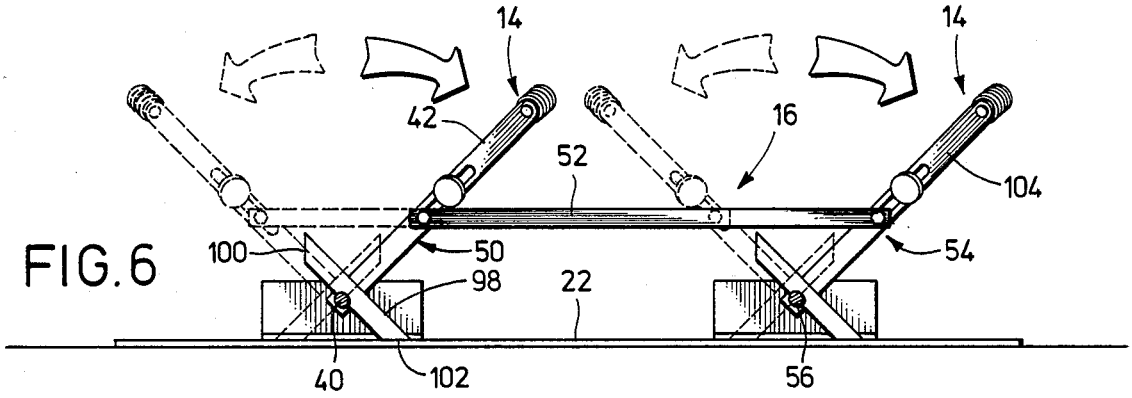
FIG. 6

TEAM ARM WRESTLING MACHINE

BACKGROUND OF THE INVENTION

1. Field of the Invention

A team arm wrestling machine is disclosed whereby multiple persons may join together in competition through simultaneous participation in use of the machine. The machine has two or more pairs of opposed operating levers mounted on shafts which are linked together to permit the arm wrestlers to participate as a team.

2. Description of the Prior Art

Competitions testing the strength of contestants have been known and enjoyed for many years. Some, such as wrestling, require a degree of supervision and equipment and are staged between individual contestants. Others, such as tug-of-war require minimal equipment and permit contestants to participate as a team.

Arm wrestling has long been popular as a sport where two individual contestants face each other across a table in a contest of strength. Conventionally, the contestants place their elbows on a table and grasp hands. At the beginning of the contest, their forearms are in a generally upright position, and at the signal to begin, each contestant attempts to pin the back of the opponent's arm against the table. While this competition is quite simple, it has certain inherent weaknesses in that opponents' arms may be of varying length and the opponents have a tendency to raise the elbow from the table to achieve greater leverage.

In order to combat these deficiencies, a number of arm wrestling machines have been developed or proposed, such as the machine for arm wrestling disclosed in our U.S. Pat. No. 4,463,949. However, all of these machines have focused on ways to improve the competition by eliminating various advantages in technique or leverage. None have attempted to alter the basic one-on-one character of the competition to provide a means for additional competitors to simultaneously participate as a team.

SUMMARY OF THE INVENTION

The present invention solves the problem of the inability of a number of arm wrestling contestants to simultaneously participate on teams by providing a machine having multiple stations. Thus, a series of arm wrestling stations may be linked together in unison for team arm wrestling competition. The disclosed arm wrestling machine broadly includes a flat supporting surface, two or more pairs of spaced apart levers, means connecting each pair of levers, and means linking each of the pairs of levers for simultaneous pivoting. Each pair of levers are joined together and are pivotally mounted on the flat supporting surface. The levers in each pair may be joined together by, for example, a shaft or through a gear linkage. The levers of each pair pivot through opposed, generally vertical planes, and preferably the levers operated by members of the same team will pivot in substantially the same plane.

In preferred forms, one of the shafts carries a counterbalancing mechanism adapted to offset the weight of the levers and linkage of the unit which otherwise would act to assist the contestants actively prevailing in the contest. The mechanism includes a pair of spaced apart sprockets carried by the main shaft, each sprocket carrying a chain attached to a tensioned spring. The springs for each sprocket face in opposing directions to the spring on the counterpart sprocket and exert equal tension on each of the sprockets. The springs thus bias the shaft and therefore the levers to a central, upright position, with the tension increasing on one spring as the levers are rotated opposite the spring, thereby offsetting the advantage caused by the weight of the lever.

The arm wrestling machine includes an arm centering device useful to recenter the contestant's arms at a central, upright position at the beginning of each match. The device is in the form of a collar carried on one of the shafts which collar has a flattened surface engageable with a spring biased bar when the levers and thus the contestants' arms are centered. This centering device assures a uniform, central starting position prior to the commencement of each match.

BRIEF DESCRIPTION OF THE DRAWINGS

FIG. 4C is a perspective view of the arm centering collar;

FIG. 5 is a fragmentary sectional view along line 5—5 of FIG. 2 showing the counterbalancing device in an operational mode as when a contestant has pivoted the lever away from its centered position; and FIG. 6 is a fragmentary sectional view along line 6—6 of FIG. 1 showing the arm stop and final positions of the levers in phantom.

DESCRIPTION OF THE PREFERRED EMBODIMENT

Figure 1:
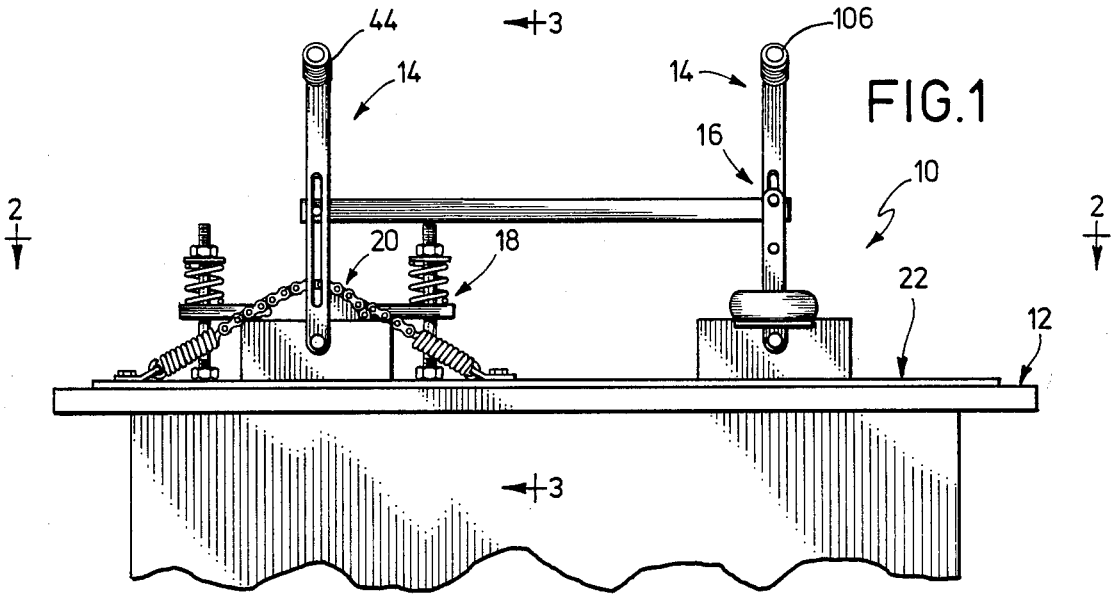
FIG. 1 is a fragmentary side elevational view of the arm wrestling machine with one armrest removed.

The arm wrestling machine 10 broadly includes a table 12, lever and handle assembly 14, connecting linkage 16, arm centering device 18, and counterbalancing mechanism 20.

Figure 2:
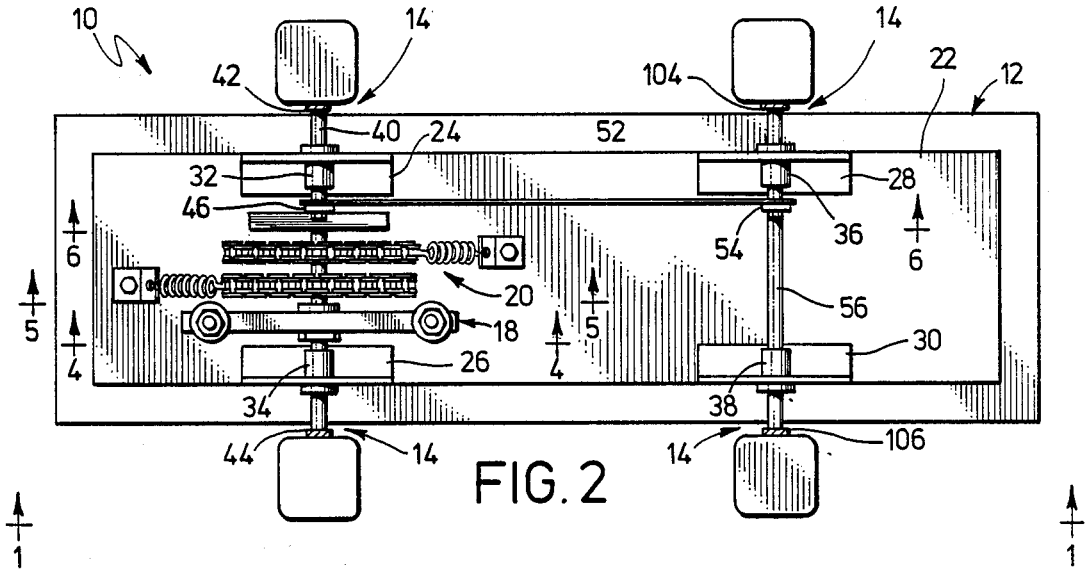
FIG. 2 is a sectional view along line 2—2 of FIG. 1 showing the interior structure of the arm wrestling machine.

Referring first to FIGS. 1 and 2, table 12 carries a flat supporting surface or plate 22 and two pairs of spaced angles 24, 26, and 28, 30. Angles 24 and 28 are mounted opposite angles 26 and 30 on plate 22. The opposed angles are each apertured to receive corresponding bushing and collar assemblies 32, 34, and 36, 38. An elongated main shaft 40 is supported between angles 24 and 26 and within assemblies 32 and 34 for pivoting. A lever and handle assembly 14 is mounted on each end of shaft 40 for bidirectional pivoting, each lever and handle assembly 14 including mated upwardly and obliquely extending, spaced apart opposed levers 42, 44 respectively. Handles 46 and 48 are secured to the upper end of each of the levers 42, 44 respectively.

Connecting linkage 16 includes an upstanding connecting arm 50 secured to main shaft 40, the arm 50 having an elongated, fore and aft extending connecting bar 52 pivotally connected to the upper end thereof.

The connecting bar 52 is in turn pivotally connected to a similar connecting arm 54 adjacent the rearward end of the machine. The arm 54 is secured to a second, transversely extending shaft 56, supported by angles 28 and 30. Shaft 56 also carries a mated pair of upstanding levers and grips identical to those of shaft 50. As can be appreciated, this arrangement provides a total of four lever and handle assemblies 14 interconnected through the shafts 40 and 56 and the connecting linkage 16. Thus, pivoting of any lever and handle assmbly 14 produces responsive pivoting of the remaining assemblies 14.

Figure 3:
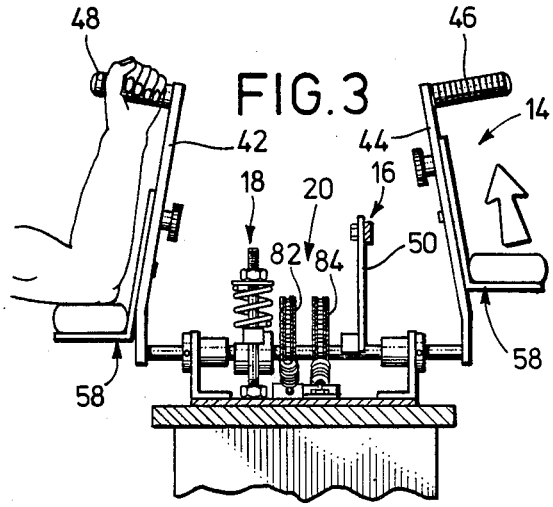
FIG. 3 is a vertical sectional view taken along line 3—3 of FIG. 1, showing the position of the arm and hand of a contestant while grasping a lever.

Each of the lever and handle assemblies 14 is provided with a vertically adjustable arm support 58 which is releasably connected to each of the levers by conventional means as detailed in FIG. 3. As can be appreciated, use of this arm support 58 permits each individual user to adjust the effective height of his own lever and handle.

Figure 4A:
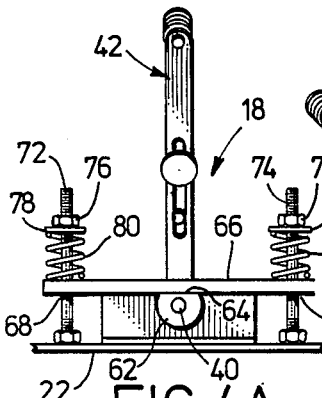
FIG. 4A is a fragmentary sectional view along line 4—4 of FIG. 2 showing the position of the centering device, grip and lever when the arm wrestling machine is in the centered, initial position.
Figure 4B:
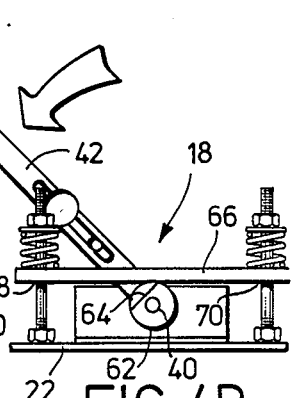
FIG. 4B is a fragmentary sectional view along line 4—4 of FIG. 4 showing the centering device, grip and lever in an operational mode as when a contestant has rotated the lever away from its centered position.

Arm centering device 18 is also coupled with main shaft 40 and is shown in detail in FIGS. 4A through 4C. The purpose of the device 18 is to recenter all of the arms at the beginning of each match. To this end, shaft 40 carries an annular collar 62 having a flattened upper surface 64 as shown in FIG. 4C. A spring biased bar 66, which is rectangular in cross-section, normally rests in abutting contact with the flattened surface 64 (see FIG. 4A). Each end of the spring biased bar 66 is apertured at 68, 70. A pair of upright threaded shafts 72, 74 are supported on the plate 22, passed through apertures 68 and 70 respectively and each carry a nut 76 and a flat washer 78. A compression spring 80 is situated between the underside of washer 78 and the upper surface of the spring biased bar 66 as shown whereby to exert a downward pressure on bar 66.

The main shaft 40 also carries a pair of laterally spaced apart half sprockets 82 and 84. The counterbalancing mechanism 20 is associated with each of the half sprockets 82, 84 and includes (See FIG. 5) a section of chain 86 secured to one end 88 of each half sprocket. Chain 86 is trained around half sprocket 84 with coil spring 90 secured to the free end 92 of the chain 86, and in turn is coupled to the plate 22.

A similar chain and spring attachment is secured to sprocket 82, but chain 94 is trained in the opposite direction of chain 86 and is secured to spring 96. Spring 96 and spring 90 exert opposing tension on shaft 40. Thus, the counterbalancing mechanism 20 serves to compensate for the weight of each of the lever and handle assemblies 14 and connecting linkage 16 as the shaft 40 turns in either direction. It is contemplated that the springs 90, 96 would be arranged so that they would never be completely at rest.

The main shaft 40 further carries an arm stop 98 (See FIG. 6) which has a pair of bevelled end surfaces 100, 102. Victory in an arm wrestling match using the machine occurs when one of the bevelled surfaces comes into contact with the plate 22 as shown in phantom in FIG. 6.

FIG. 6 further shows the operation of connecting linkage 16, which serves to maintain each pair of lever and handle assemblies 14 in the same pivotal alignment. Lever 42 and connecting arm 52 are both secured to main shaft 40 and thus pivot simultaneously. Similarly, lever 104 and connecting arm 54 are connected to shaft 56 and pivot simultaneously. Preferably, connecting arms 50 and 54 are the same length and are pivotally secured to connecting bar 52 at the same radial distance from the shaft so that each lever and handle assembly moves in simultaneous and equal relationship to the other, all as shown in FIG. 6.

In practice, prior to a match, arm centering device 16 is adjusted by means of the nut and washer assemblies 76, 78 to provide the desired degree of downwardly directed force via compression springs 80 on the spring biased bar 66. Competitors line up on opposite sides of table 12, so that two members of one team each grip a first set of lever and handle assemblies 14; namely levers 42 and 104, and two members of the other team each grip a second set of lever and handle assemblies 14: namely levers 44 and 106. Upon commencement of a match, each contestant attempts to force the opponents' arms in a direction away from the opponents' palms by pivoting his lever and grip assembly 14. Each of the lever and grip assemblies of the first set cooperate against the lever and grip assemblies of the second set, and each of the lever and grip assemblies of the second set cooperate against the lever and grip assemblies of the first set. As the shafts 40, 56 move in a given direction, the counterbalancing mechanism 20 compensates for the weight of the lever and handle assemblies 14 and connecting linkage 16 by extending one of springs 90 or 96 which in turn exerts a greater force on main shaft 40. A match is concluded when one of the bevelled surfaces 100, 102 comes into contact with plate 22.

At the conclusion of a match, it will be appreciated that shaft 40 has been rotated to a point wherein an arcuate portion of the collar 62 is in engagement with the underside of the spring biased bar 66. When the competitors release their respective lever grips, the springs 90, 96 provided with the counterbalancing mechanism serve to urge the shaft 40 back into its centered rest position shown in FIG. 4A. As the collar 62 approaches this position, it will be appreciated that the bar 66 is slightly raised in opposition to compression springs 80 until the surface 64 comes into alignment with the bottom surface of the bar 66. At this point, compression springs 80 forceably direct the bar 66 into face-to-face engagement with the flattened portion of the collar to hold the lever grip assemblies 14 in their centered, upright locations.

It will be further appreciated that additional shafts and lever and handle assemblies 14 may be added and connected to the machine by means of connecting linkage 16 in order to provide additional stations for the addition of team members. Thus, any number of contestants may compete on a single machine by adding successive connecting linkages 16, shafts, and lever and handle assemblies 14.

We claim:

1. An arm wrestling machine comprising:

a plurality of mated pairs of lever and handle assemblies, each pair having a first assembly and a second assembly, said pairs being longitudinally spaced along said machine a sufficient distance to accommodate a separate, longitudinally spaced aligned user of the machine at each lever and handle assembly, means pivotally supporting each of the lever and handle assemblies for bidirectional pivoting thereof, and for coupling the members of each mated pair for pivoting of said first assembly in response to pivoting of the second assembly coupled thereto; and means operably connecting respective mated pairs of said assemblies, said means being substantially horizontally extending, such that upon pivoting of one of the assemblies of said mated pairs, responsive pivoting of the remaining mated assemblies occurs, whereby members of a team of competitive arm wrestlers gripping and attempting to pivot said first assemblies cooperate to exert force against a second team of competitive arm wrestlers gripping and attempting to pivot said second assemblies, wherein said support means mounted on a supporting surface such that said first assemblies are mounted opposite said second assemblies and said connecting means is oriented with respect to either said supporting means or said supporting surface to prevent complete rotation of said lever and handle assemblies.

2. An arm wrestling machine as set forth in claim 1, wherein each of said first assemblies of said mated pairs pivots in a first generally vertical plane, and each of said second assemblies of said mated pairs rotates in a second, spaced generally vertical plane.

3. An arm wrestling machine as set forth in claim 2, including a plurality of shafts, each of said mated pairs being shaft mounted.

4. An arm wrestling machine as set forth in claim 3, wherein said connecting means includes a connecting arm mounted on each shaft and a connecting bar pivotally coupled to said connecting arms.

5. An arm wrestling machine as set forth in claim 3, including an arm stop mechanism located on a first of said shafts.

6. An arm wrestling machine as set forth in claim 5, including counterbalancing means.

7. An arm wrestling machine as set forth in claim 6, said counterbalancing means comprising a pair of shaft mounted half sprockets, a chain trained over each of said sprockets, one end of each chain being secured at an end of each sprocket and the other end secured to a coil spring, said chains being trained in opposite directions, said coil springs being connected to said supporting surface and positioned such that said coil springs would never be completely in relaxation.

8. An arm wrestling machine as set forth in claim 3, including an arm centering device.

9. An arm wrestling machine as set forth in claim 8, wherein said arm centering device comprises an annular collar mounted on the first shaft, a flat surface on the collar, and a spring biased bar mounted in engagement with said collar, such that said lever and grip assemblies are all in an upright, substantially vertical position when the flat surface of said collar is in engagement with said bar.

10. An arm wrestling machine comprising:

a substantially horizontal plate;

a first shaft pivotally mounted on said plate;

a second shaft pivotally mounted on said plate and oriented parallel to said first shaft;

a pair of opposed, spaced apart lever and handle assemblies mounted on each shaft such that each lever and handle assembly is in the same pivotal alignment, said lever and handle assemblies on said first shaft being longitudinally spaced apart a sufficient distance from said lever and handle assemblies on said second shaft to accommodate a separate, longitudinally spaced aligned user of said machine at each lever and handle assembly;

means connecting said first shaft to said second shaft to maintain said assemblies in constant pivotal alignment; and means for supporting an arm of each of a plurality of users, said users being arm wrestling competitors, such that a forearm of said arm of each arm wrestling competitor is substantially aligned with said lever and handle assemblies during pivoting of said lever and handle assemblies.

11. An arm wrestling machine as set forth in claim 10, wherein said connecting means includes a connecting arm mounted on each shaft and a connecting bar pivotally coupled to said connecting arms.

12. An arm wrestling machine as set forth in claim 10, including an arm stop mechanism located on a first of said shafts.

13. An arm wrestling machine as set forth in claim 10, including counterbalancing means.

14. An arm wrestling machine as set forth in claim 13, said counterbalancing means comprising a pair of shaft mounted half sprockets, a chain trained over each of said sprockets, one end of each chain being secured at an end of each sprocket and the other end secure to a coil spring, said chains being trained in opposite directions, said coil springs being connected to said supporting surface and positioned such that said coil springs would never be completely in relaxation.

15. An arm wrestling machine as set forth in claim 10, including an arm centering device.

16. An arm wrestling machine as set forth in claim 15, wherein said arm centering device comprises an annular collar mounted on the first shaft, a flat surface on the collar, and a spring biased bar mounted in engagement with said collar, such that said lever and grip assemblies are all in an upright, substantially vertical position when the flat surface of said collar is in engagement with said bar.

17. An arm wrestling machine comprising:

means for receiving force applied by an arm of a first competitive arm wrestler including a first lever and handle assembly;

means for receiving force applied by an arm of a second competitive arm wrestler including a second lever and handle assembly;

means for receiving force applied by an arm of a third competitive arm wrestler including a third lever and handle assembly;

means for receiving force applied by an arm of a fourth competitive arm wrestler including a fourth lever and handle assembly;

means pivotally supporting each of said lever and handle assemblies for bidirectional pivoting thereof;

means interconnecting said first and second lever and handle assemblies for pivoting about a first common axis extending therebetween;

means interconnecting said third and fourth lever and handle assemblies for pivoting about a second common axis extending therebetween, said first and second axes being spaced apart and oriented to be substantially parallel in a common, substantially horizontal plane;

means operably connecting said first and second lever and handle assemblies with said second and fourth lever and handle assemblies such that force applied by a first team comprised of said first and third arm wrestlers cooperate to oppose the collective force applied by a second team comprised of said second and fourth arm wrestlers to produce simultaneous, corresponding responsive pivoting in each of said first, second, third and fourth lever and handling assemblies; and an arm stop mechanism located on one of said interconnecting means.

18. An arm wrestling device as set forth in claim 17, including an arm centering device.

* * * * *